US007089872B2

(12) United States Patent
Wintermute, II et al.

(10) Patent No.: US 7,089,872 B2
(45) Date of Patent: Aug. 15, 2006

(54) SUPPORT FOR MODULAR CONTAINERS WITH OUTWARDLY-EXTENDING ACCESS PANELS

(75) Inventors: William R. Wintermute, II, Phillipsburg, NJ (US); Robert Friedman, Millburn, NJ (US); Carmine Bucalo, Cranbury, NJ (US)

(73) Assignee: Mars, Incorporated, McLean, VA (US)

( * ) Notice: Subject to any disclaimer, the term of this patent is extended or adjusted under 35 U.S.C. 154(b) by 293 days.

(21) Appl. No.: 10/627,095

(22) Filed: Jul. 24, 2003

(65) Prior Publication Data

US 2005/0022703 A1 Feb. 3, 2005

Related U.S. Application Data

(60) Provisional application No. 60/398,535, filed on Jul. 24, 2002, provisional application No. 60/398,534, filed on Jul. 24, 2002.

(51) Int. Cl.
*A47B 43/02* (2006.01)

(52) U.S. Cl. ..... 108/165; 211/135; 312/259

(58) Field of Classification Search ..... 108/165, 108/166, 167; 211/135, 149, 132.1, 126.16, 211/126.6; 312/259; 206/561
See application file for complete search history.

(56) References Cited

U.S. PATENT DOCUMENTS

| | | | | |
|---|---|---|---|---|
| 3,121,511 | A | 2/1964 | Whitehead | |
| 3,207,380 | A | 9/1965 | Hennessey | |
| 3,265,246 | A | 8/1966 | Messenger | |
| 3,278,080 | A | 10/1966 | Di Luco | |
| 3,528,597 | A | 9/1970 | Zastrow | |
| 3,593,908 | A | 7/1971 | Desmond et al. | |
| 3,715,623 | A * | 2/1973 | Szabo | 315/292 |
| 3,747,833 | A | 7/1973 | Robinson | |
| 3,944,128 | A | 3/1976 | Hogan | |
| 4,186,866 | A | 2/1980 | Zicko | |
| 4,488,652 | A * | 12/1984 | Hinton et al. | 211/149 |
| 4,618,115 | A * | 10/1986 | Belokin, Jr. | 211/135 |
| 4,646,937 | A | 3/1987 | Doshi | |
| 5,141,105 | A * | 8/1992 | Maye | 211/135 |
| 5,213,220 | A * | 5/1993 | McBride | 211/132.1 |
| 5,315,936 | A * | 5/1994 | Smith | 108/165 |
| 5,458,272 | A | 10/1995 | Ward-Weber | |
| 5,632,390 | A * | 5/1997 | Podergois | 211/149 |
| 5,678,492 | A * | 10/1997 | Pinkstone et al. | 108/165 |
| 5,706,959 | A | 1/1998 | Smith | |
| 5,826,732 | A * | 10/1998 | Ragsdale | 211/149 |
| 5,857,586 | A | 1/1999 | Scherr | |
| 6,068,140 | A * | 5/2000 | Mangrum et al. | 211/132.1 |
| 6,126,254 | A | 10/2000 | Maglione | |
| 6,189,778 | B1 | 2/2001 | Kanter | |

(Continued)

FOREIGN PATENT DOCUMENTS

DE 296 16 865 11/1996

(Continued)

*Primary Examiner*—Jose V. Chen
(74) *Attorney, Agent, or Firm*—Fitzpatrick, Cella, Harper & Scinto

(57) ABSTRACT

A module support for forming a unitary display preferably from containers having outwardly extending access panels. In particular, a common module support for creating an array from two or more container modules is provided. The module support may be advantageously utilized as a stand alone display for floor, shelf, and/or counter placement. The module support may also be hung on a wall or column using hanging elements, e.g., double-sided adhesives, hook and loop fastening elements, and hook and/or aperture elements.

18 Claims, 6 Drawing Sheets

U.S. PATENT DOCUMENTS

| | | | | |
|---|---|---|---|---|
| 6,216,944 | B1 | 4/2001 | Maglione | |
| 6,612,669 | B1 * | 9/2003 | Grueneberg | 108/165 |
| 6,752,280 | B1 * | 6/2004 | Dye | 211/149 |

FOREIGN PATENT DOCUMENTS

| | | |
|---|---|---|
| EP | 0 295 503 | 12/1988 |
| GB | 2 340 385 | 2/2000 |

* cited by examiner

SUPPORT FOR MODULAR CONTAINERS WITH OUTWARDLY-EXTENDING ACCESS PANELS

This application claims the benefit of U.S. Provisional Patent Application Nos. 60/398,534, and 60/398,535, both of which were filed on Jul. 24, 2002. The entire specifications of both applications is incorporated by reference herein.

BACKGROUND OF THE INVENTION

1. Field of the Invention

The present invention relates to a module support for containers having outwardly extending access panels. The invention provides, in particular, a common module support for creating an array from two or more container modules. The invention may be advantageously utilized as a stand alone display for floor, shelf, and/or counter placement. The invention may also be hung using hanging means, e.g., double-sided adhesives, hook and loop fastening means, and hook and aperture means.

2. Related Background Art

Product manufacturers and distributers, hereinafter "sellers", sell a majority of their products in retail and wholesale stores. Since product display space in these stores is often limited and densely occupied, sellers compete for space on store shelves, floors, walls, columns, and counters. Further, since high product visibility and ease of product accessibility are major factors in product sales, sellers also compete for certain areas on shelves, floors, and the like. As a result, consumer eye level and other high visibility areas in stores are highly sought after. Unfortunately, high visibility display space is even more limited than general display space.

The inability of a product seller to secure product placement in high visibility areas may lead to lack of consumer awareness of the sellers' product, reduced sales, and loss of sales revenue. Low product sales may lead to a product being "pulled" from store shelves in order to make space available for presumed better selling products. Limited store space leads to other problems as well, including reduced product carry away ease in the case of products placed in out-of-the-way or cramped areas.

Sellers have attempted to address product visibility problems by providing product containers with artwork that makes the containers more readily visible by the consumer. Now, however, since nearly all sellers utilize the same methods of making their products more visible, individual containers again become unobvious amidst a virtual sea of brightly decorated product cartons.

Aside from shelves, stores have several areas for display that are un- or underutilized, e.g., walls and columns. Most conventional shipping and display containers, however, can not make viable use of these display areas since the containers are not designed for upright use, do not have hanging means, or both. Enumerable advantages can be realized through the use of upright containers with access panels, with or without hanging means. Further, since store display space is limited, it would be even more advantageous if different products could be "bundled" together prior to receipt at the point of sale for display at the point of sale. This would provide customizable consumer displays for the bundling of various consumer products for point of sale distribution. For example, a maker of confectioneries could bundle one carton containing a plurality of one type of candy bar, another carton containing a plurality of a different type of candy bar, and yet another carton containing another consumer product in a common support having promotional and/or seasonal graphics printed thereon. The cartons within the support could have generic and/or product-related graphics printed thereon; so, when the promotion is over, the seller could easily remove the cartons from the support and continue to sell products from the individual generically-decorated cartons. Obviously, substantial savings could be realized by the product distributer since the distributer would no longer have to print cartons with seasonal an/or promotional graphics thereon. The distributor would print generic cartons and or cartons with product-related information. Seasonal and/or promotional graphics would be printed on the support reducing costs associated with ever-changing carton graphics. Also, assembly of the displays would not be labor intensive for the distributer even though sellers order custom displays with seller selected products contained therein. The seller would receive an assembled custom display that requires little or no labor prior to being displayed and a display that is easy to disassemble into individual product cartons when the seller desires or after a promotion is over.

Sellers have designed cartons with access panels, dispensation areas, and hanging means. See, e.g., U.S. Pat. Nos. 3,121,511; 3,207,380; 3,265,246; 3,278,080; 3,528,597; 3,593,908; 3,747,833; 3,944,128; 4,186,866; 4,646,937; 5,458,272; 5,857,586; 6,189,778; 6,216,944; and, European Patent No. 0 295 503. Unfortunately, none of these prior art references disclose a singular, customizable common module support to be shared by more than one carton, each having a radially-openable access panel, and/or assembly of various sizes of carton modules in a module support that allows for easy assembly and disassembly.

Accordingly, the need remains for a way to customizably "bundle" more than one multi-unit product container in a manner that makes use of underutilized store display areas, allows the products to be more obvious to consumers, and is easy to assemble, ship, display, and disassemble, while maintaining or increasing consumer accessibility of the products housed within the product carton.

SUMMARY OF THE INVENTION

The present invention is directed to a way to customizably "bundle" more than one multi-unit product container in a manner that makes use of underutilized store display areas, allows the products to be more obvious to consumers, and is easy to assemble, ship, display, and disassemble, while maintaining or increasing consumer accessibility of the products housed within the product carton.

A first embodiment is a module support blank for forming a unitary display comprised of a plurality of cartons, each having a carton access panel, said blank comprising: a first back panel integrally connected on a side thereof to a back side of a first side panel; a second back panel integrally connected on a side thereof to a back side of a second side panel; at least one face panel integrally connected on opposing sides to a front side of said first side panel and a front side of said second side panel; and at least one access area disposed between said first side panel and said second side panel and located above or below said face panel, wherein when said blank surrounds said plurality of cartons said access area provides access to said carton access panels.

A second embodiment is a unitary display comprising: a plurality of cartons, each having a carton access panel; and a module support holding said plurality of cartons together to form said unitary display, wherein said module support includes a first back panel integrally connected on a side thereof to a back side of a first side panel, an inner surface of said first back panel disposed on at least a portion of an outer back surface of at least one carton and an inner surface of said first side panel disposed on at least a portion of an outer side surface of at least one carton; a second back panel integrally connected on a side thereof to a back side of a second side panel, an inner surface of said second back panel disposed on at least a portion of an outer back surface of at least one carton and an inner surface of said second side panel disposed on at least a portion of an outer side surface of at least one carton; at least one face panel integrally connected on opposing sides to a front side of said first side panel and a front side of said second side panel, said face panel disposed on a portion of an outer front surface of at least one carton; and at least one access area providing access to at least one carton access panel.

Unless otherwise stated, all units of measure are standard SI units. Any cited documents are, in relevant part, incorporated herein by reference. Various alterations to the present invention will be apparent to a skilled artisan upon viewing the figures and reading the specification including the claims appended hereto.

DETAILED DESCRIPTION OF THE FIGURES

Figure 4:
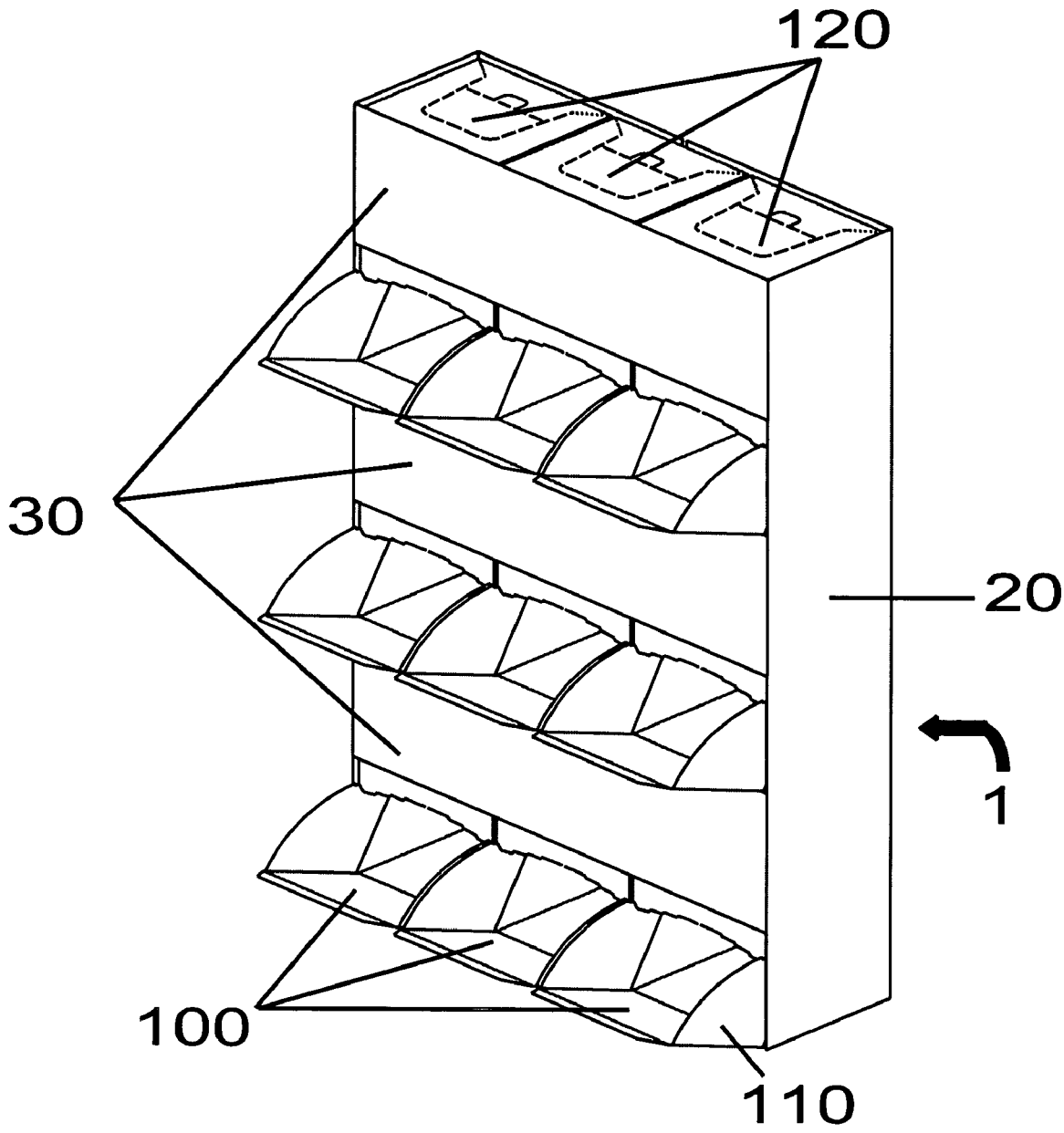

FIG. 4 is an isometric view of a preferred embodiment in an erected state. Preferred modules to be housed therein are shown with their access panels in the open position. This preferred embodiment has three tiers with three modules in each tier. The array may be modified by, for example, replacing the three modules with one, two, four, or more modules of varying sizes on any or all tiers.

Figure 5:
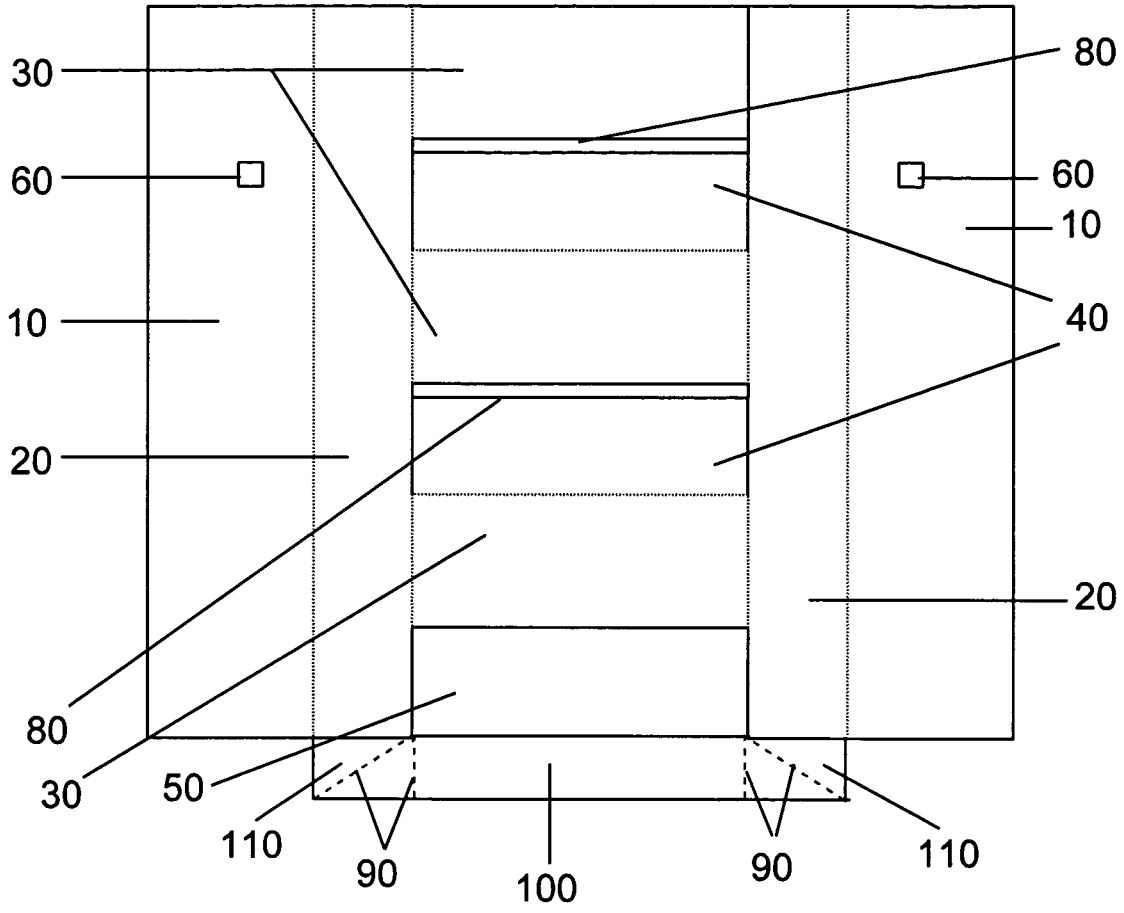

FIG. 5 is a top view of a preferred embodiment having a module support bottom panel in a flat and unaffixed state. Specifically, it is a bottom panel-equipped module support blank as it would leave a die-cut machine.

Figure 6:
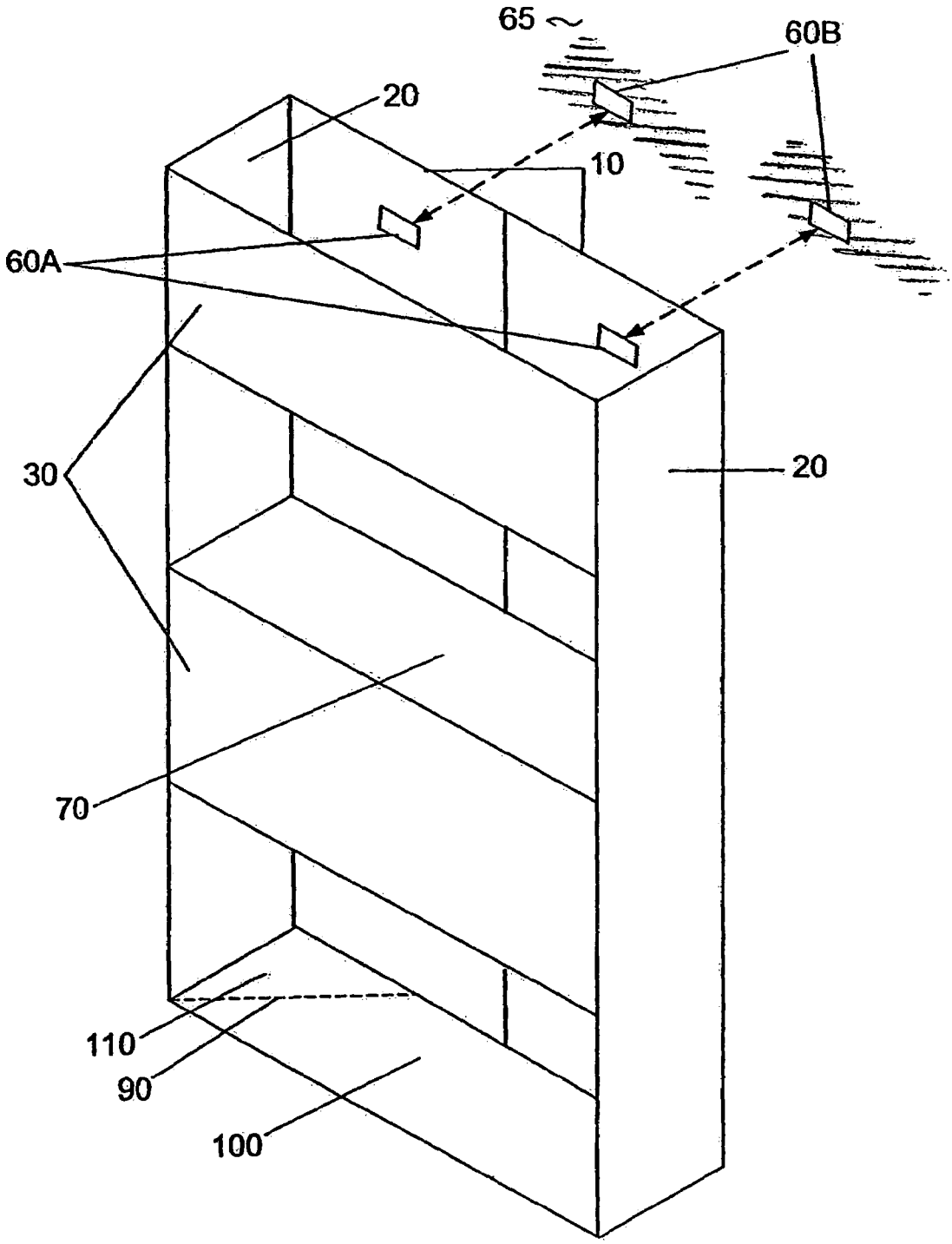

FIG. 6 is an isometric view of a preferred embodiment having a module support bottom panel and in an erected state. The containers to be housed therein are not shown; however, the module support bottom panel is shown in one of its possible final positions.

DETAILED DESCRIPTION OF THE INVENTION

As used herein, the term "module", "carton", or "container" is intended to mean any container designed to hold two or more individual product units. Construction materials include, but are not limited to, paperboard, corrugated paperboard, cardboard, plastic, and combinations thereof. Other construction materials will be apparent to a skilled packaging artisan.

As used herein, the term "access panel" as it relates to preferred containers to be housed within the module support, is intended to mean an opening, a radially-openable panel, a flap covered opening, or other openings known to skilled artisans, the only proviso being that the module support does not inhibit access to the access panel even though the module support wraps around the front and towards the rear of the carton modules contained therein.

As used herein, the term "radial", as it relates to the operation of the access panel disposed on preferred containers to be housed within the module support, is intended to mean the access panel operates in much the same manner as a door; whereby when it is opened or closed, its path is that of a pie slice with an arc defining its outermost path boundary. The access panel preferably opens only a predetermined amount.

As used herein, the term "side", as it relates to the point of connection to another panel (e.g., "front side" or "back side") is intended to refer to proximity of the point of connection to the face panel of the module support. In other words, "front side" refers to the edge of the panel being discussed that is closest to the face panel. Likewise, "back side" refers to the edge of the panel being discussed that is farthest from the face panel.

Product cartons serve a primary role in the shipment of product units for individual sale. Cartons also provide a simple means to stock stores with numerous retail units without individually handling numerous individual retail units. Product cartons also provide containment means for multiple product units placed on, e.g., store counters and shelves. For example, candy bars and other snack foods would take an inordinate amount of time to stock if they were not packed, e.g., 25–30 per carton. Instead, the carton is opened; and, the entire carton is placed in a display area.

However, as discussed hereinbefore, current product cartons pose an obstacle to attaining consumer attention and easing consumer accessibility. Most cartons are also limited to placement on standard store shelves leaving other store display areas underutilized. It has been surprisingly discovered that an array of two or more cartons can be provided with increased product visibility, ease of consumer accessibility, and cost-effective and relatively simple manufacturing, erection, assembly, shipping, display, and disassembly techniques. Further, the arrays are customizable as to product types, sizes, and amounts based on the sellers' preferences. Promotional and/or seasonal graphics may be printed on the module support reducing or eliminating the need to continuously alter the graphics printed on individual carton modules and/or carton modules with outdated promotional/seasonal graphics printed thereon. By enabling the printing of generic graphics on carton modules, the carton modules can be easily separated from the module support for individual display after the promotion is over. While the following discussion will focus primarily on array display systems that are rectangular in shape, the inventive module support can work for other carton shapes including triangular and cylindrical shapes without departure from the spirit and scope of the invention.

The module support and/or cartons housed therein may also be equipped with means for affixing them to a wall, shelfless display rack, e.g., pegboard rack, column, or other display area. The means may include, for example, double-sided tape, hook and loop fastener means, e.g. Velcro®, and apertures designed to accommodate a peg in a pegboard rack, an s-hook for hanging on an aperture-containing surface, and vice versa.

Figure 3:
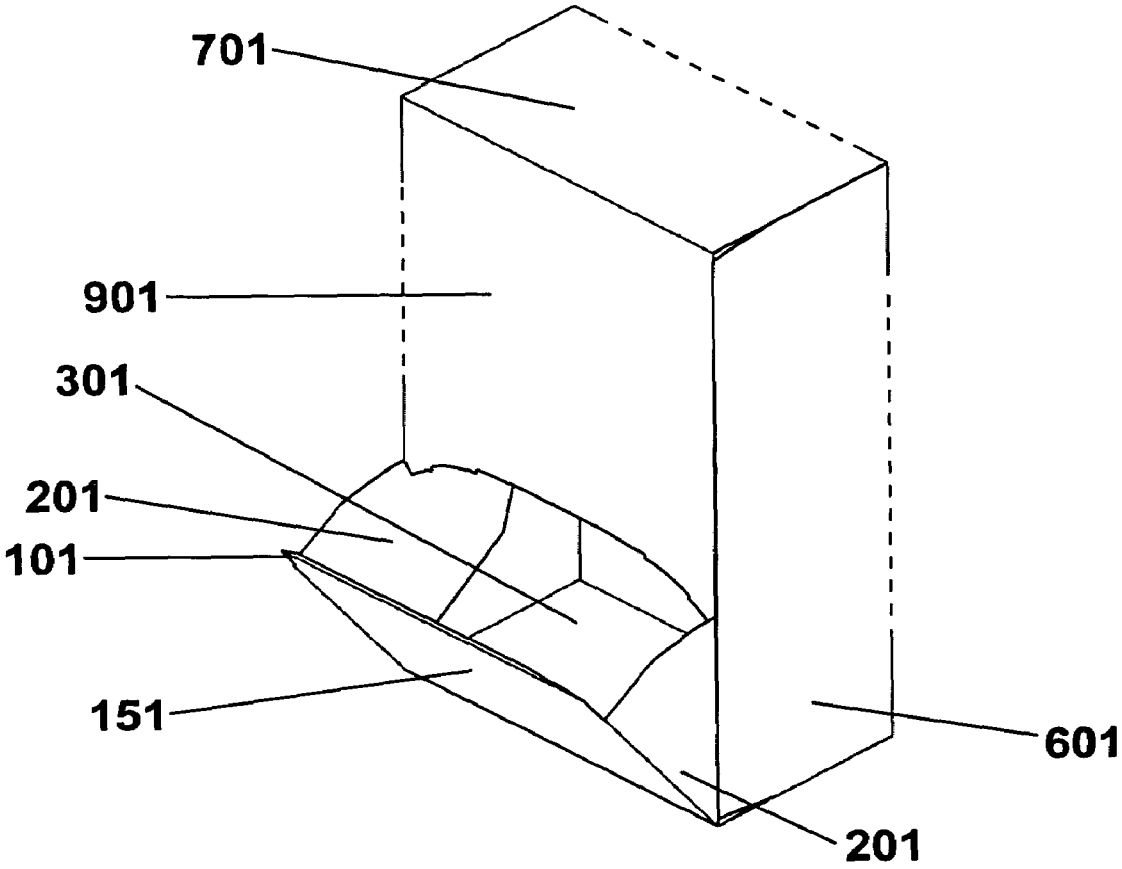
FIG. 3 is an isometric view of a preferred module having and access panel disposed on its front. In a preferred embodiment, this module is of the general type to be housed within the module support blank.

The containers used in the array preferably comprise an access panel that preferably opens in a radial manner, and, preferably, to a predetermined amount. The predetermined opening amount can be controlled with a holding means, e.g., at least one, more preferably two, side arms disposed on the access panel. Other holding means known to the skilled artisan are also envisioned. The side arm preferably limits access panel opening via at least one notch disposed on at least one side arm. The access panel is preferably capable of being opened and closed repeatedly. Further, the containers are preferably usable without the module support since the capability to separate containers from each other is envisioned and preferred. FIG. 3 depicts a preferred container described in U.S. Provisional Patent Application No. 60/398,535 filed on Jul. 24, 2002, and entitled "Upright Carton with Outwardly-Extending Access Panel".

The carton in FIG. 3 has two opposing sides, 601, a bottom, 301, a top, 701, a front panel, 901, a back panel, and an access panel, 151. The access panel preferably has two opposing side arms, 201, and an access panel lip, 101. The length and/or angular orientation of side arms, 201, may be modified to vary the amount the access panel opens. A skilled artisan will appreciate that all container panel sizes may be modified depending on whether, for example, narrow, tall and narrow, short and narrow, wide, short and wide, and tall and wide cartons are desired for the modular display.

An advantage of the present invention is that several sizes and/or shapes of containers may be fit into the same modular display. For example, a modular display having three tiers may include one wide container in the top tier, two narrower containers in the middle tier, and another wide container in the bottom tier. A skilled artisan can appreciate a multitude of display options by altering the size of the modular support blank, the number of tiers in the modular support blank, the size of the containers, and/or the shapes of the containers. Another advantage is the ability to print promotional/seasonal graphics on the module support allowing the easily removable individual carton modules to be printed with generic/product specific graphics not specific to a particular promotion and/or season.

Figure 1:
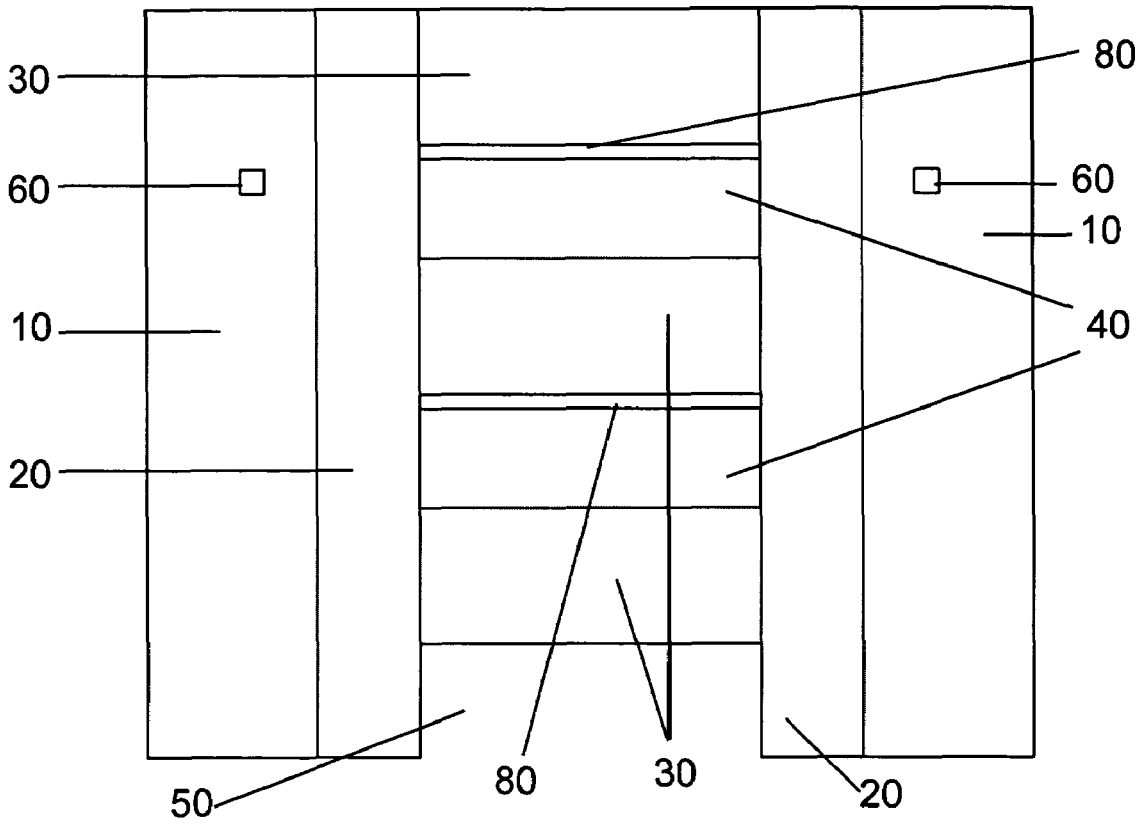
FIG. 1 is a top view of a preferred embodiment in a flat and unaffixed state. Specifically, it is a module support blank as it would leave a die-cut machine.

A preferred embodiment of a multi-container module support blank in accordance with the present invention is shown in FIG. 1. An un-erected module support blank is one that is removed from the die-cutting machine without assembly or affixation of any of the panels. A preferred embodiment of the inventive module support as illustrated in FIG. 1 is comprised of two back panels, 10, two side panels, 20, a front panel comprised of at least one face panel, 30, and at least one access area, 40, and optionally one lower access area, 50. Access area, 40, may be an opening or, preferably, is defined, at least in part, by a shelf panel, 70, perforated or cut along its borders with side panels, 20, and either is perforated or cut along its upper border with the face panel, 30, immediately above the access area or bordered by gap, 80. Preferably, the blank comprises gap(s), 80, situated between shelf panel(s), 70, and the face panel, 30, immediately above the shelf panel. Gap, 80, can assist in positioning containers as well as facilitate the set-up of shelf panel, 70, along its perforation score.

Another preferred embodiment of a multi-container module support blank in accordance with the present invention is shown in FIG. 5. This preferred embodiment of the inventive module support is comprised of the same features illustrated in FIG. 1 with the addition of module support bottom panel, 100. Module support bottom panel, 100, has gusset sides, 110, which have gusset fold lines or scores, 90. The fold/score lines enable easy folding of gusset sides during assembly of the unitary display or array. Optionally, gusset sides, 110, may be folded manually or pre-glued, whereby the inner sides of the outermost corners of gusset sides, 110, are glued to the inner sides of side panels, 20. In this pre-glued form, lifting side panels, 20, to a position perpendicular to face panel(s), 30, would consequently lift modular support bottom panel, 100, to its preferred orientation and would prepare the modular support for loading with a modular container(s).

Figure 2:
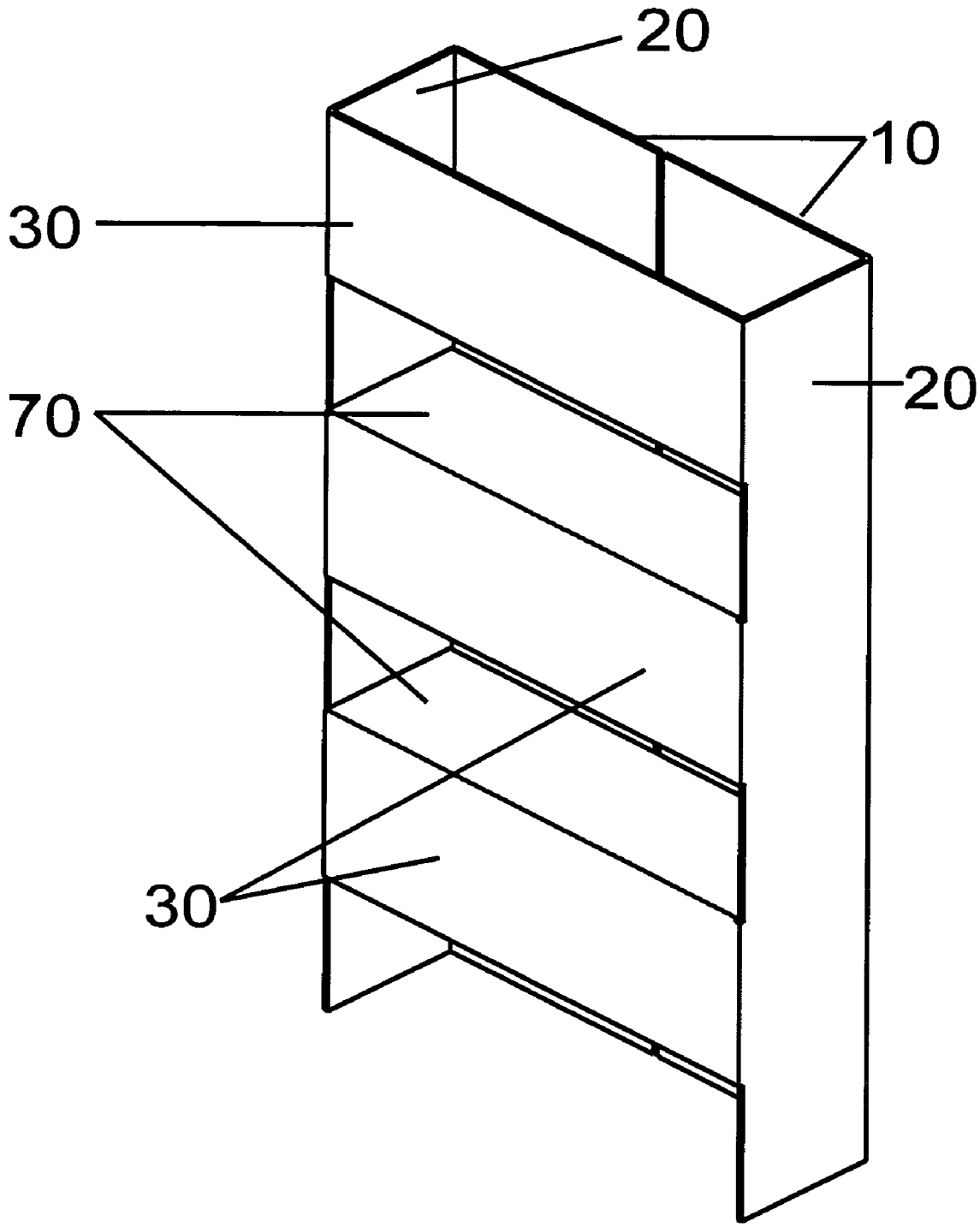
FIG. 2 is an isometric view of a preferred embodiment in an erected state. The containers to be housed therein are not shown.

Shelf panel, 70, when present as illustrated in FIGS. 2 and 6, may be torn along the perforations or separated if it is almost completely cut with only small attachment areas/nicks and folded in a manner that creates an opening in the face of the module support and a shelf inside the module support. The shelf defines a separation between containers to be housed within the module support and provides further rigidity to the module support when loaded with containers. More importantly, the shelf allows containers to be efficiently positioned within the module support such that the containers' access panels are properly aligned with the module support's access area. As can be elucidated from the figures, a shelf is not required, but is a preferred option since each shelf acts as a placement guide for containers above and below the shelf.

As stated hereinbefore, the module support bundles two or more containers for display together. FIG. 2 depicts a module support upright and assembled; however, the containers that would be housed therein are not shown. In order to assemble the module support with containers, the module support blank is preferably placed face down, and, if present, shelf panel(s), 70, is folded or torn along its perforations or separated if it is almost completely cut with only small attachment areas/nicks and folded until perpendicular with face panel(s), 30. Suitably sized containers with front access panels are arranged such that their access panels are accessible from access area, 40. Two or more narrower containers may be placed side-by-side to utilize the same access area, 40, or a single wider carton may utilize an entire access area, 40, depending on the desired configuration. As can be appreciated by the skilled artisan, module supports with a single or multiple tiers can provide several array combinations. Individual face panels, 30, on the same module support may have different heights to accommodate several shapes and sizes of containers as well as various array configurations. The sizes of side panels, 20, and back panels, 10, can also be adjusted for various containers. As stated above, the skilled artisan can appreciate a myriad of different array possibilities.

FIG. 4 depicts an exemplary and preferred unitary display 1 that is a three tier embodiment with three cartons per tier. The tops, 120, of the three cartons in the uppermost tier are visible. Also depicted is the module support's side panel, 20, and face panels, 30. Preferred modules with open carton access panels, 100, having preferred side arms, 110, are shown protruding through the module support's access area, 40.

The module support blank may include a fixative somewhere on the inner side. The fixative may be, for example, one or more pressure activated double-sided adhesive strips running the entire width of the inner side of the module support blank such that one or more panels of each carton placed in the module support are affixed to the module support after an array is assembled. Double-sided adhesive may also/alternatively be placed height-wise on the inner side of the module support. More preferably, box-sealing tape or the like is utilized to reduce costs. In any regard, it is preferable the fixative and/or tape not contact the carton modules so as not to deface the graphics printed thereon. In particular, the preferred embodiment having a module support bottom panel depicted in FIGS. 5 and 6 enables the array to be assembled without the need for fixative and/or tape to contact the carton modules contained therein.

Another suitable fixative is heat sensitive adhesive, applied when the adhesive is in a melted condition. When adhering two surfaces together, melted adhesive is applied to the first surface, then the second surface is placed in immediate contact with the first surface. The melted adhesive quickly solidifies shortly after the two surfaces are brought together since the ambient temperature of the surfaces cool the adhesive almost immediately after joining. Preferably, the surfaces to be adhered together are held under compression for a period of time until the adhesive has set. Of course, assembly of the array may be done by machine as can be appreciated by a skilled artisan.

As one of ordinary skill in the art will appreciate, surfaces may also be joined by including interlocking portions on the surfaces. For example, one surface may include a cut-out or slot for receiving a corresponding locking member from another surface for connection thereto.

As stated hereinbefore, it is preferable the module support and carton modules be assembled without fixative and/or tape applied between the modules and the module support. This may be achieved, for example, by joining back panels, 10, together with box sealing tape or the like once array assemble is complete. If back panels, 10, are sized such that their outermost edges meet upon folding around the backs of the carton modules, tape or the like may be used to join the outermost ends of back panels, 10. The tape or the like may be affixed running along the seam created where the outermost edges of back panels, 10, meet. Preferably, the tape continues down and around the bottom of the assembly and preferably does not continue around to the front of the assembly.

If the preferable bottom panel-equipped module support is used, the tape procedure is the same with the exception that tape will not contact the carton modules on the bottom. Instead, the module support bottom panel will be in the folded position, as shown in FIG. 6, preferably covering the entirety of the bottom of the carton module(s) in the only or lowermost tier of the assembly. When the tape is run around the bottom of the assembly, the tape will be affixed to the module support bottom panel instead of the carton module bottom(s). Even disassembly is simplified since the assembly may be turned upside down and shaken until the carton modules slide out. Alternatively or additionally, tape may be peeled away and/or cut allowing separation of the module support and the carton module(s) contained therein. In any regard, disassembly is simplified and the defacing of any graphics on the carton module(s) may be avoided advantageously allowing separate display of aesthetically in-tact carton modules.

After carton modules are situated within the module support, the module support must be folded around the cartons from the front to the rear of the cartons and affixed. To do this, side panels, 20, are folded towards the carton modules by bending the module support between side panels, 20, and face panel(s), 30. Back panels, 10, are then folded towards the carton modules by bending the module support between back panels, 10, and side panels, 20. If a bottom panel-equipped module support is used, the module support bottom panel must also be folded into position. This may be done, for example, by folding module support bottom panel, 100, and gusset sides, 110, towards the carton modules. Prior to module support bottom panel, 100, making abutting-contact with the carton modules, gusset sides, 110, are each folded half-wise diagonally along fold/score lines, 90, and inwardly toward the bottom(s) of the carton module(s). With gusset sides, 110, folded, module support bottom panel, 100, can be abutted with the bottom(s) of the carton module(s). If desired, module support bottom panel, 100, may be folded into position prior to placement of the carton modules. Then, the carton modules can be placed to sandwich gusset sides, 110, between the sides of the carton module(s) and side panel, 20, of the support module. If fixative is used, once it sets between the module support and the carton modules, unitary display assembly is complete. Alternatively or additionally, the taping procedures described hereinbefore may be utilized.

The unitary display may be optionally wrapped with a protective material such as plastic, stacked with other arrays in a columnar fashion and wrapped with a protective material such as plastic and/or strapped together, and/or palletized along with other array columns and wrapped with a protective material such as plastic and/or strapped together prior to shipping. Pre-pack embodiments of the present invention are preferred, i.e., embodiments where the unitary displays are shipped to the point-of-sale filled with product and ready for display after opening the access panels of the cartons within the unitary display. Preferably, the unitary display is capable of simple disassembly.

The module support may be equipped with perforations or tear strips running the entire height of the module support at or near the outermost edge of back panel, 10. If a unitary display is to be disassembled allowing separate placement of individual carton modules, the tear strips or perforations can be torn and the modules separated from the module support. Perforations may also be situated at the outermost boundaries of any strips of fixative. Therefore, when disassembly is desired, the module support may be separated from the carton modules at fixative containing points only. Most preferably, back panels, 10, of the module support are joined with tape or the like without tape/fixative affixing the module support to the carton modules such that the carton modules may be "dumped" from the top of the module support, or, at the very least, such that any graphics on the carton modules are not defaced upon disassembly of the display. Disassembly of a unitary display would be desirable, for example, if the entire contents of one or more carton modules have been removed and continued display of carton modules containing products is desired. The cessation of promotional or other activities may also create the desirability for separate modules if the graphics on the module support are limited to that activity since, preferably, the graphics on the carton modules themselves would lend the carton modules to conventional or non-promotional display. Again, one potential advantage of utilizing a common module support is the ability to unite various carton modules under one theme while retaining the ability to separately display the carton modules at any point.

To assist opening of the access panels on cartons contained in a unitary display, perforations and/or tear areas may be provided on the cartons. Other opening means will be apparent to the skilled packaging artisan. With the access panel in each carton in the unitary display operable, the unitary display may be placed on the store floor, counter, rack, column, or wall. It is preferred the module support be equipped with hanging means enabling the entire array to be hung on a column or wall. FIG. 1 depicts optional hanging apertures, 60, disposed on back panels, 10, of the module support. Alternatively, the hanging means 60 may be a hook and loop means, e.g., Velcro®, for attaching the module support to a wall, as depicted in FIG. 6. Here, the hook portion 60A is connected to the loop portion 60B, appended to a wall surface 65. Also, the carton modules themselves may also be equipped with hanging means. The carton module hanging means may be purposefully designed for mating with support module hanging means, e.g., aperture, 60, in FIG. 1, and/or designed for the carton modules' individual use after removal from the display.

The module support, as well as the cartons contained therein, may include printed information on the panels thereof. In preferred embodiments, the carton modules are printed with information generally related to type, amount, color, flavor, etc., of the products contained therein, while the module supports are printed with seasonal, promotional, or other themes uniting various carton modules.

All module support components or a unitary module support may be manufactured from paperboard, corrugated paperboard, corrugated paper board laminated with plastic or other materials, or the like, produced with cutting dies and printing plates according to processes well known to the skilled artisan. With such processes, sheets of material are cut into flat panels which are later folded around, and, optionally, affixed to carton modules as hereinbefore described. Such folds provide exemplary internal connections between the panels.

A variety of fixatives may be used which are sufficient for affixing the module support to carton modules. It is preferable, however, that box sealing tape be applied externally to join the back panels, 10, together for assembly efficiency and cost-effectiveness. A stated hereinbefore, this will avoid the defacing of carton module graphics upon disassembly. Module support manufacture, carton module placement, unitary display assembly, and unitary display erection may be partially or fully automated. Such process would print graphics on the module support, apply adhesive(s) if necessary, and cut the module support. Then, at an assembly point, product-filled carton module(s) may be properly positioned in the module support, and the module support may be folded and affixed to create the unitary display containing a plurality of cartons. Any of the above-described processes may be partially or fully automated.

Other embodiments of the present invention will be apparent to the skilled artisan. While the appended claims distinctly point to specific embodiments, embodiments falling within the spirit and scope of the preceding specification are also encompassed.

We claim:

1. A module support blank for forming a unitary display comprised of a plurality of cartons, each having a carton access panel, said blank comprising:

a) a first back panel integrally connected on a side thereof to a back side of a first side panel;

b) a second back panel integrally connected on a side thereof to a back side of a second side panel;

c) at least one face panel integrally connected on opposing sides to a front side of said first side panel and a front side of said second side panel;

d) at least one access area disposed between said first side panel and said second side panel and located above or below said face panel, and e) at least one shelf panel disposed between said first side panel and said second side panel and located above or below said face panel and having two perforated and detachable or cut opposing sides bordering said first and second side panels, said at least one shelf panel being movable or removable by tearing or cutting along perforations to form said at least one access area.

2. The module support blank according to claim 1, further comprising a module support bottom panel.

3. The module support blank according to claim 1, having two face panels and said access area is disposed there between.

4. The module support blank according to claim 1, having three face panels and two access areas, said access areas alternately disposed between said face panels.

5. The module support blank according to claim 1, further comprising means for affixing said blank to a plurality of cartons.

6. The module support blank according to claim 1, further comprising at least one unitary display hanging element.

7. The module support blank according to claim 6, wherein said unitary display hanging element is a hook and loop fastening element.

8. The module support blank according to claim 6, wherein said unitary display hanging element is a hook opening disposed on each of said back panels.

9. The module support blank according to claim 1, wherein there is a gap between a top of said shelf panel and a face panel disposed above said shelf panel.

10. The module support blank according to claim 1, wherein a border of a top of said shelf panel is perforated and detachable from a face panel disposed above said shelf panel.

11. The module support blank according to claim 1, wherein said blank is constructed of corrugated paperboard.

12. A unitary display comprising:

a) a plurality of cartons, each having a carton access panel; and b) a module support holding said plurality of cartons together to form said unitary display, wherein said module support includes:

i) a first back panel integrally connected on a side thereof to a back side of a first side panel, an inner surface of said first back panel disposed on at least a portion of an outer back surface of at least one carton and an inner surface of said first side panel disposed on at least a portion of an outer side surface of at least one carton;

ii) a second back panel integrally connected on a side thereof to a back side of a second side panel, an inner surface of said second back panel disposed on at least a portion of an outer back surface of at least one carton and an inner surface of said second side panel disposed on at least a portion of an outer side surface of at least one carton;

iii) at least one face panel integrally connected on opposing sides to a front side of said first side panel and a front side of said second side panel, said face panel disposed on a portion of an outer front surface of at least one carton; and v) at least one access area providing access to at least one carton access panel.

13. The unitary display according to claim 12, wherein said module support further comprises a module support bottom panel, an inner surface of said module support bottom panel disposed on at least a portion of an outer bottom surface of at least one carton.

14. The unitary display according to claim 12, further comprising at least one shelf panel disposed under at least one carton and integrally connected to a top side of said at least one face panel.

15. The unitary display according to claim 12, having two cartons positioned side by side with at least one face panel and one access area providing access to each carton access panel.

16. The unitary display according to claim 15, further comprising a shelf panel disposed under said two cartons and integrally connected to an upper edge of said lower face panel.

17. The unitary display according to claim 12 having two cartons, one positioned on top of the other, said cartons having disposed therebetween a shelf panel, and wherein said carton access panels are each accessible from a separate access area.

18. The unitary display according to claim 12 having three cartons, two of said cartons positioned side by side and having said access panels accessible from one access area and the other carton having its access panel accessible from another access area, wherein said two cartons and said other carton have disposed therebetween said shelf panel.

* * * * *